US007104183B2

(12) United States Patent
Huang

(10) Patent No.: US 7,104,183 B2
(45) Date of Patent: Sep. 12, 2006

(54) ONE-PIECE STEEL PISTON

(75) Inventor: Yuejun Huang, Fort Wayne, IN (US)

(73) Assignee: Karl Schmidt Unisia, Inc., Marinette, WI (US)

( * ) Notice: Subject to any disclaimer, the term of this patent is extended or adjusted under 35 U.S.C. 154(b) by 23 days.

(21) Appl. No.: 10/885,810

(22) Filed: Jul. 7, 2004

(65) Prior Publication Data

US 2006/0005700 A1 Jan. 12, 2006

(51) Int. Cl.
*F01B 31/08* (2006.01)

(52) U.S. Cl. ..... 92/186; 29/888.04

(58) Field of Classification Search ..... 92/186; 29/888.04

See application file for complete search history.

(56) References Cited

U.S. PATENT DOCUMENTS

| | | | | |
|---|---|---|---|---|
| 1,835,863 | A | 12/1931 | Greve | |
| 2,244,008 | A | 6/1941 | Hazen et al. | |
| 5,070,768 | A | 12/1991 | Goncalves et al. | |
| 5,839,352 | A | 11/1998 | Ribeiro et al. | |
| 6,112,642 | A * | 9/2000 | Jarrett et al. | 92/186 |
| 6,223,701 | B1 | 5/2001 | Kruse | |
| 2004/0168319 | A1 * | 9/2004 | Mielke | 29/888.04 |

FOREIGN PATENT DOCUMENTS

| | | | |
|---|---|---|---|
| DE | 1210302 * | 12/1959 | 92/186 |
| DE | 44 46 726 A1 | 12/1994 | |
| EP | 0 992 670 A2 | 10/1999 | |
| WO | WO 01/50042 A1 | 7/2001 | |

* cited by examiner

*Primary Examiner*—F. Daniel Lopez
(74) *Attorney, Agent, or Firm*—Butzel Long

(57) ABSTRACT

A one-piece steel piston that is made from a piston blank that includes a portion that configured and designed to be displaced to form a cooling gallery and ring belt. The piston blank can be formed by a casting or forging process. The portion that is designed and configured to be displaced is a flange that extends radially at the top of the piston blank. The flange is bent downward so that a peripheral edge of the flange contacts a top portion of the piston skirt. The peripheral edge of the flange and the top portion of the skirt can be welded together or provided with inter-engaging structures.

23 Claims, 3 Drawing Sheets

ONE-PIECE STEEL PISTON

TECHNICAL FIELD

The present invention relates to piston designs for internal combustion engines. More specifically, the present invention relates to a one-piece steel piston design and a method of making the same.

BACKGROUND ART

Internal combustion engine pistons are exposed to extremely tough working environments. They are subjected to high temperatures, explosive firing pressures, side forces and inertial forces. As an engine's output is increased more and more, temperatures, cylinder pressures and engine speed can become so high that traditional materials from which pistons are made, including aluminum alloys, reach their fatigue strengths.

Articulated pistons are two-piece pistons that have a crown made of steel and a skirt made from aluminum. The crown and skirt are joined together by means of a piston pin. In articulated pistons, the crown and skirt are able to articulate so as to move independently of each other.

Articulated pistons provide several advantages over one-piece cast aluminum pistons. For example, the steel crown in articulated pistons has a thermal expansion rate that is more similar to the thermal expansion rate of iron piston liners than aluminum. Heat from the steel crowns of articulated pistons is not as easily transferred to the aluminum skirt so the skirt retains its shape better.

Although articulated pistons can withstand relatively higher pressures and temperatures there are some practical design limitations associated with articulated pistons. For example, since articulated pistons require longer piston pins, making the total piston assembly (piston plus piston pin) generally heavier than one-piece aluminum piston assemblies. In addition, since the piston crown and skirt move independently of each other the skirt cannot effectively function to guide movement of the piston crown. Accordingly, the piston land has to guide movement of the piston crown. This results in land to cylinder liner contact which can cause cavitation problems. Another design limitation associated with articulated pistons is that there is no connection between the ring belt and skirt. This allows stresses to be very high in the cooling gallery and on the bowl edge, which can cause cracks to occur. Moreover, the lack of connection between the ring belt and skirt and resulting stresses allow for ring groove deformations to be very high which can cause oil consumption, blow-by, and emission problems.

Piston designers have been trying very hard to come up with new technologies to overcome the problems associated with articulated pistons. A number of proposed solutions have focused on one-piece steel pistons. Unlike articulated piston, the skirt and crown of one-piece steel pistons form an integrated unit with the piston crown having a cooling gallery in it. Examples of patented one-piece steel pistons are found in DE 44 46 726 A1 to Kemnitz, U.S. Pat. No. 6,223,701 to Kruse, EP 0 992 670 A1 to Gaiser et al., and International Application Publication No. WO 01/50042 to Gaiser et al.

One of the most challenging aspects of one-piece piston designs is creating a cooling gallery in the piston crown while at the same time ensuring sufficient margins for fatigue strength and minimizing ring groove deformations subject to loads. In DE 44 46 726 A1 the piston is not connected between ring belt and skirt. Therefore, the overall structure of the piston is not stable and high stress can cause deformation to occur in the piston crown. In addition, because the skirt of the piston is short in DE 44 46 726 A1, high contact pressures will be created between the skirt and cylinder liner. Moreover, the shortness of the skirt used in DE 44 46 726 A1 limits the ability of the skirt to guide the movement of the piston so that cavitations can occur with respect to the cylinder liner. Overall, the process of manufacturing the one-piece piston of DE 44 46 726 A1 is very intensive.

WO01/50042 A1 involves joining upper and lower crown sections by a friction weld. The friction welding used in this piston design changes the original material properties. Moreover, cracks can occur in the welding areas either during welding or subsequent heat treatment or heating. In addition, because welding flashes in a cooling gallery cannot be removed they will reduce the effective cooling gallery volume and could, in a worst case scenario, block the cooling gallery completely. Further, as a result of friction welding, metal particles remaining in the cooling gallery could damage an engine if they are released from the cooling gallery while the engine is running.

The present invention is directed to a one-piece steel piston that is made from a piston blank that is provided with a portion that configured and designed to be displaced to form a cooling gallery and ring belt.

DISCLOSURE OF THE INVENTION

According to various features, characteristics and embodiments of the present invention which will become apparent as the description thereof proceeds, the present invention provides a one-piece piston that includes:

a top;

a pair of opposed pin bosses with pin bores formed therein;

a skirt; and a cooling gallery that is comprises an annular cavity formed in a side of the piston which annular cavity is closed by a flange that is continuous with the top of the piston and which has been displaced so as to closed the annular cavity and define a portion of the cooling gallery.

The present invention further provides piston blank from which a piston can be fabricated, the piston blank including a top portion, a skirt, a pair of opposed pin bosses and a flange extending radially outward from the top portion, the flange being configured to be displaced downward to contact a top portion of the skirt.

The present invention also provides method of fabricating a one-piece piston which involves:

providing a piston blank having a top portion, a skirt, a pair of opposed pin bosses and a flange extending radially outward from the top portion;

forming an annular cooling gallery under the flange;

displacing the flange so that an outer peripheral edge of the flange contacts a top portion of the skirt and closes off the cooling gallery; and forming piston ring grooves in the flange.

BRIEF DESCRIPTION OF DRAWINGS

The present invention will be described with reference to the attached drawings which are given as non-limiting examples only, in which.

BEST MODE FOR CARRYING OUT THE INVENTION

The present invention is directed to one-piece steel pistons for internal combustion engines. The one-piece steel pistons of the present invention are formed from single unitary steel forged or cast parts which are subsequently subjected to machining and metal working processes. The one-piece steel pistons include cooling galleries which may be partially formed during the forging or casting process and which are completely formed after the subsequent machining and metal working. The pre-machined, pre-metal-worked forged or cast parts herein referred to as "piston blanks" from which the one-piece steel pistons are produced each include a portion that is configured to be displaced during metal working to define the final one-piece pistons. The forged or cast parts from which the one-piece steel pistons are produced are also provided with and/or machined to have abutment portions which assist in properly positioning the displaced portions as they are displaced. The displaced portions can be welded together or configured to mechanically interlock with a top portion of the skirt.

The process of manufacturing the one-piece steel pistons of the present invention involves forging or casting a pre-machined and pre-metal worked piston or piston blank that includes a top potion, a skirt, a pair of opposed pin bosses, and a flange that extends radially outward from the top. Optionally, the pre-machined and pre-metal worked forged piston or piston blank can be forged with a rough (pre-finished) crown bowl and/or a rough (pre-finished) cooling gallery and/or rough (pre-finished) pin bores. In the next step the cooling gallery is provided or finished by a machining step and an annular abutment is formed at the top of the skirt. Next, the flange is bent or folded downward so that the peripheral edge of the flange contacts abutment and rests on the top of the skirt. Prior to bending or folding the flange, the flange is machined so that the peripheral edge of the flange cooperates with the abutment to either mechanically engage the abutment or to be welded to the top portion of the skirt. After the flange is bent or folded grooves for compression rings and an oil ring are formed in a portion of the flange that defines the ring belt in the finished piston. At any convenient time during the above steps, the pin bores may be provided and/or finished and the under crown area can be machined out as desired to reduce overall weight.

The one-piece steel pistons of the present invention can be made from any suitable steel material that can be worked as described below and that is capable of withstanding the high combustion pressures, high piston speeds, high temperatures and mechanical stresses that are common in the environment of internal combustion engines. Various known types of carbon steel materials that suitable for purposes of the present invention. The piston blank can be made by a forging or casting process.

Figure 1:
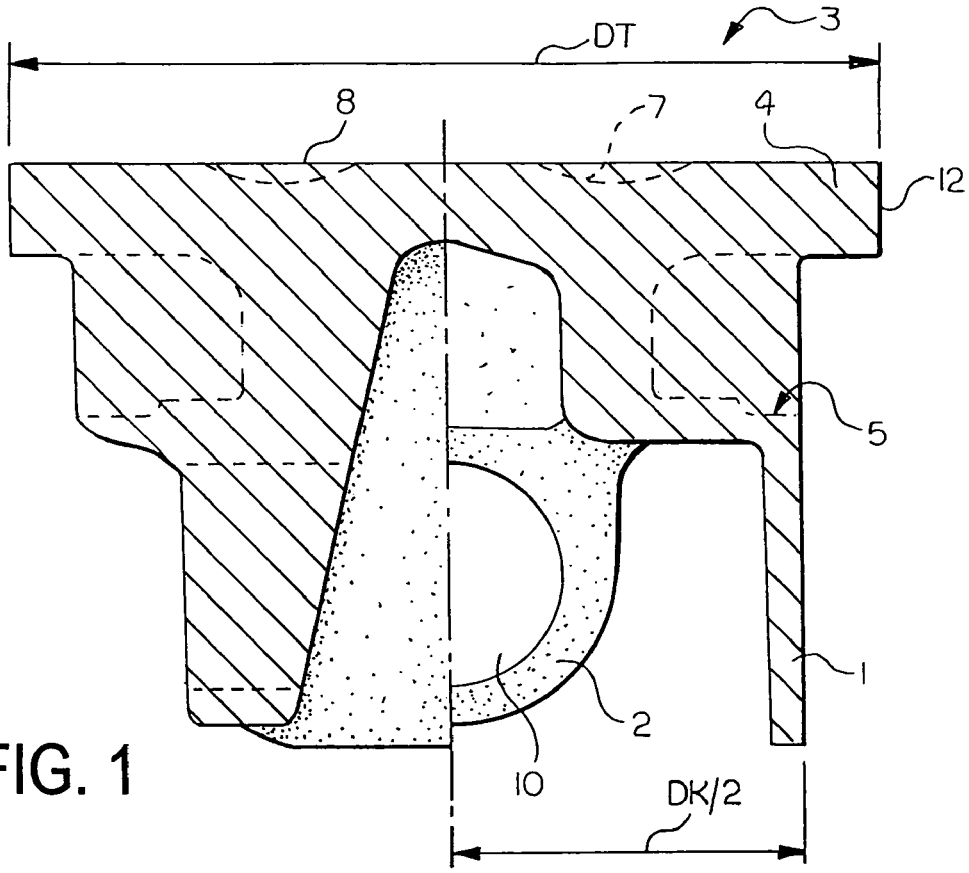
FIG. 1 is a compound cross-sectional view thorough the pin bore (right hand side) and along the thrust axis (left hand side) of a piston according to one embodiment of the present invention shown in half section before the T-form flange is worked into its final position.

FIG. 1 is a compound cross-sectional view thorough the pin bore (right hand side) and along the thrust axis (left hand side) of a piston according to one embodiment of the present invention shown in half section before the T-form flange is worked into its final position. The piston depicted in FIG. 1 is actually a steel forge that includes a piston skirt 1 opposed pin bosses 2 and a piston head 3 that includes a flange 4 which extends radially outward from the central portion of the piston head 3. As indicted in FIG. 1, the diameter, DT, of flange 4 is greater than the diameter, DK, of the skirt 1. The difference between the diameter, DT, of the flange 4 is at least and preferably greater that the diameter, DK, of the skirt 1 by an amount that is equal to the difference in height between the top of the piston and the top 5 of the skirt 1. The flange 4 is referred to herein as a T-fold flange due to its cross-sectional shape in relationship to the piston head 3 and the manner in which the flange 4 is folded or bend by machining as discussed in detail below for form the final one-piece piston.

As indicated in broken lines, the piston head 3 could be forged or cast with a crown shape 7 or have a flat top 8. In addition, as indicated in broken lines, a cooling gallery 9 could be partially or completely formed in the forged or cast part. It is also possible to form a rough pin hole 10 during the forging of the piston as indicated in broken lines in FIG. 1. Although the design of the one-piece steel piston of the present invention is novel, the steel forged or cast part depicted in FIG. 1 can be made using conventional forging or casting techniques that are well known to those skilled in the art.

An alternative to forming a crown shape 7 in the forged or cast piston part and/or forming a cooling gallery 9 in the forged or cast piston part and/or forming a pin bore 10 in the forged or cast piston part would be to machine one or more of these features in the forged or cast part. However, forming these features in the forged or cast part would reduce machining and material costs.

Figure 2:
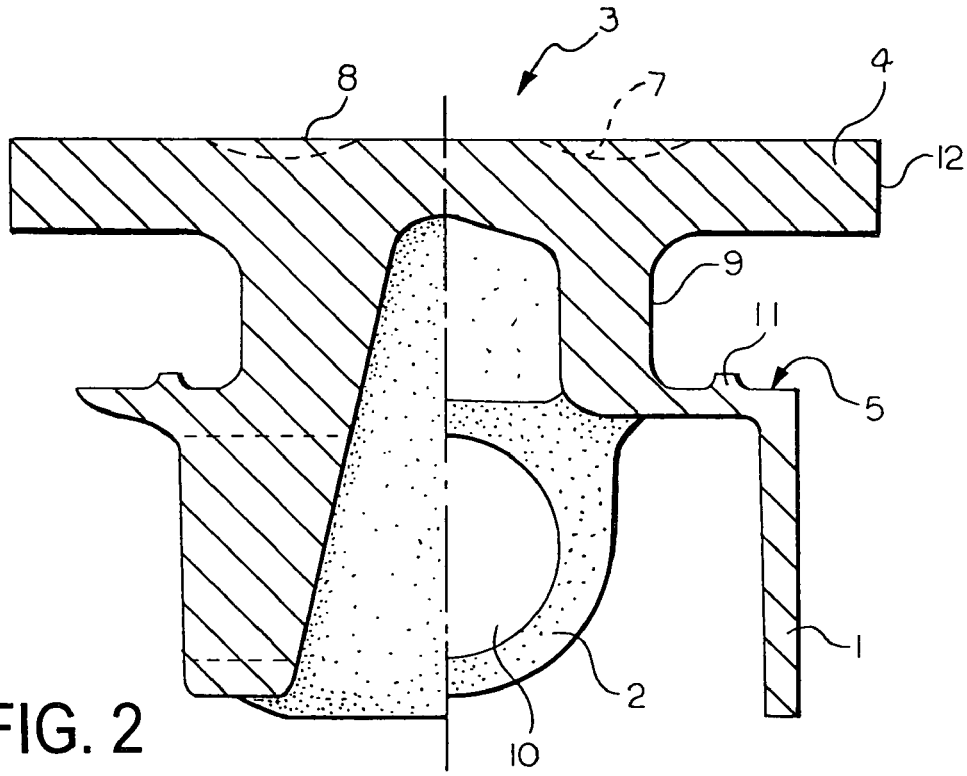
FIG. 2 is a compound cross-sectional view of a piston according to one embodiment of the present invention shown in half section with the cooling gallery machined to include a stop-log on the top of the piston skirt.

FIG. 2 is a compound cross-sectional view of a piston according to one embodiment of the present invention shown in half section with the cooling gallery machined to include a stop-log on the top of the piston skirt. In the embodiment of the piston depicted in FIG. 2 the cooling gallery 9 has been machined to a finished state in the piston. In addition, an abutment 11 has been formed has been formed on the top 5 of the skirt 1. The abutment 11 also referred to as a stop-log has an annular shape that extends circumferentially within the cooling gallery 9 along the top 5 of the skirt 1.

Figure 3:
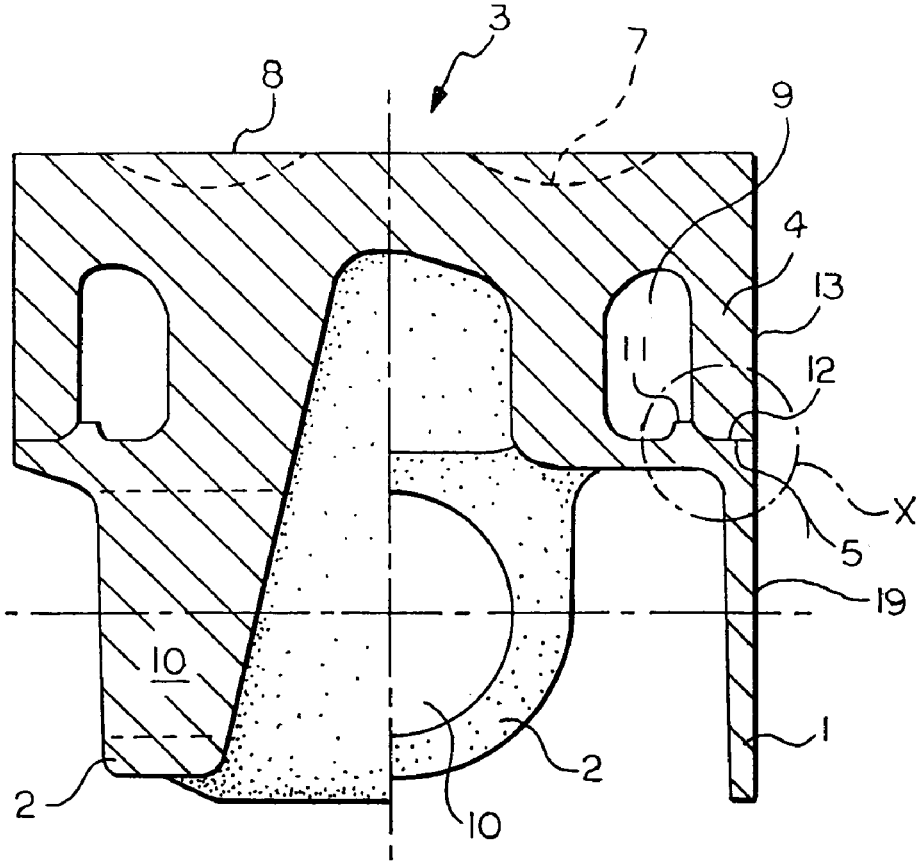
FIG. 3 is a compound cross-sectional view of a piston according to one embodiment of the present invention shown in half section with the T-form flange positioned into its final position.

FIG. 3 is a compound cross-sectional view of a piston according to one embodiment of the present invention shown in half section with the T-form flange positioned into its final position. In FIG. 3 the flange 4 has been bent or folded from its position depicted in FIGS. 1 and 2 to a position in which the flange 4 closes cooling gallery 9. As shown in FIG. 3, the outer peripheral edge 12 of the flange 4 shown in FIGS. 1 and 2 has been displaced by bending or folding the flange 4 so that the peripheral edge 12 contacts abutment 11 and rests on top 5 of the skirt 1.

From FIG. 3 it can be seen that the flange 4 is configured, e.g. forged or cast and/or machined, so that when the peripheral edge 12 of the flange 4 contacts abutment 11 the annular side surface 13 of the flange 4 (formerly top surface) is substantially in alignment with the annular side surface 19 of the skirt 1 so that the overall outer annular surface of the final piston is substantially continuous. The peripheral edge 12 of the flange 4 has also been machined in FIG. 3 so as to conform to the configuration of the abutment 11.

The flange 4 can be bent or folded from its forged position depicted in FIG. 1 to its position depicted in FIG. 3 by bending the flange 4 towards the skirt 1 while spinning the piston about its central axis, a process referred herein as "spining bending." During the bending process the flange 4 can be heated. In addition, the bending of the flange 4 can be performed in one or more steps. It is also possible to bend the flange 4 toward the skirt 1 using one or more bending forms or any other conventional metal forming processes/apparatus.

Figure 4:
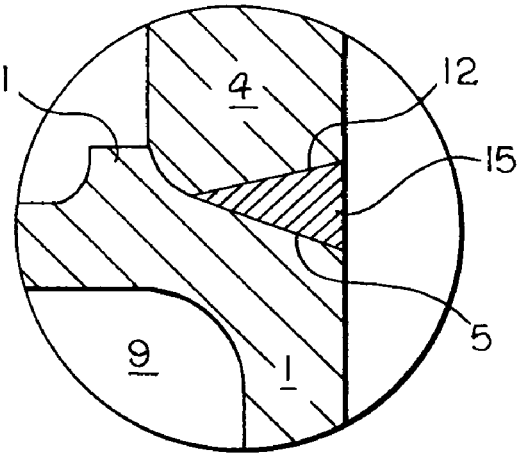
FIG. 4 is a sectional view depicting one manner in which the T-form flange is welded to the top of the piston skirt according to one embodiment of the present invention.

FIG. 4 is a sectional view depicting one manner in which the T-form flange is welded to the top of the piston skirt according to one embodiment of the present invention. In FIG. 4 the peripheral edge 12 of the flange 4 is welded to the top 5 of the skirt 1 using a conventional welding technique. FIG. 4 depicts the weld seam 15 as being substantially flush with the outer annular surfaces of the flange 4 and the skirt 1. Such a configuration can be achieved by providing any necessary gap between the peripheral edge 12 of the flange 4 and the top 5 of the skirt 1 and after welding, finishing the weld bead so that the seam 15 is smooth. It is noted that since the weld seam 15 can be configured so that it does not extend into the cooling gallery 9. Accordingly, there is no apprehension that flashing from the welding process will obstruct the cooling gallery 9 or that the welding process will deposit metal particles in the cooling gallery 9 which could be released during operating of an engine containing the piston.

Figure 5:
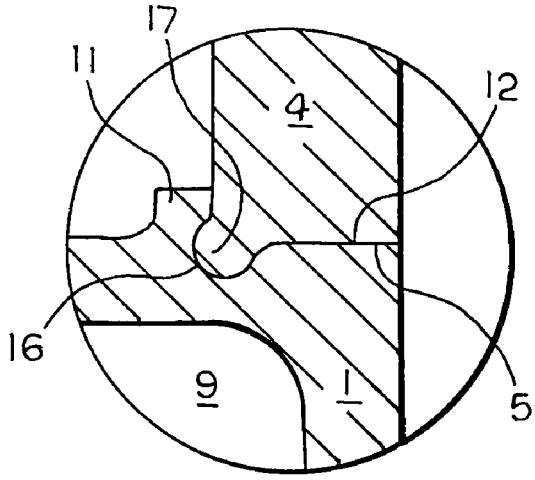
FIG. 5 is a sectional view depicting one manner in which the T-form flange can be mechanically coupled to the top of the piston skirt according to one embodiment of the present invention.

FIG. 5 is a sectional view depicting one manner in which the T-form flange can be mechanically coupled to the top of the piston skirt according to one embodiment of the present invention. In the embodiment of the invention depicted in FIG. 5, the top 5 of the skirt 1 is provided with an annular recess 16 and the peripheral edge 12 of the flange 4 is provided with an annular projection 17 that is configured to be received in the recess 16. The recess 16 and projection 17 on the flange 4 are depicted as having circular cross-sectional shapes wherein the narrowest portion of the opening of the recess 16 is less than the diameter of the recess 16 so that the projection 17 can be press-fit into the recess and secured therein. In alternative embodiments of the present invention the mechanical coupling of the flange 4 to the top 5 of the skirt 1 can be achieved using any cooperating, engaging structures which prevent the flange 4 from separating from the top 5 of the skirt 1, including one or more recesses/projections having various configurations.

Figure 6:
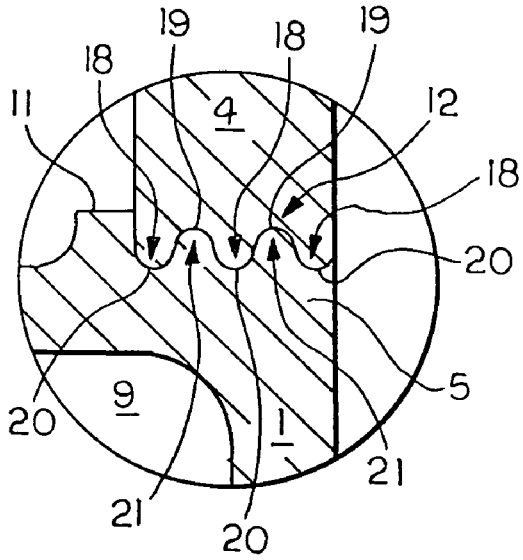
FIG. 6 a sectional view depicting one manner in which the T-form flange can be mechanically coupled to the top of the piston skirt according to another embodiment of the present invention.

FIG. 6 a sectional view depicting one manner in which the T-form flange can be mechanically coupled to the top of the piston skirt according to another embodiment of the present invention. In the embodiment of the invention depicted in FIG. 6 the peripheral edge 12 of the flange 4 is provided with alterative projections 18 and recesses 19 that engage and interlock with complementarily shaped recesses 20 and projections 21 formed on the top 5 of the skirt 1. From FIGS. 5 and 6 it can be understood that the mechanical coupling of the flange 4 to the top 5 of the skirt 1 can be achieved using any cooperating, engaging structures which prevent the flange 4 from separating from the top 5 of the skirt 1 and that the invention is not limited to the mechanical coupling structures depicted in FIGS. 5 and 6.

Figure 7:
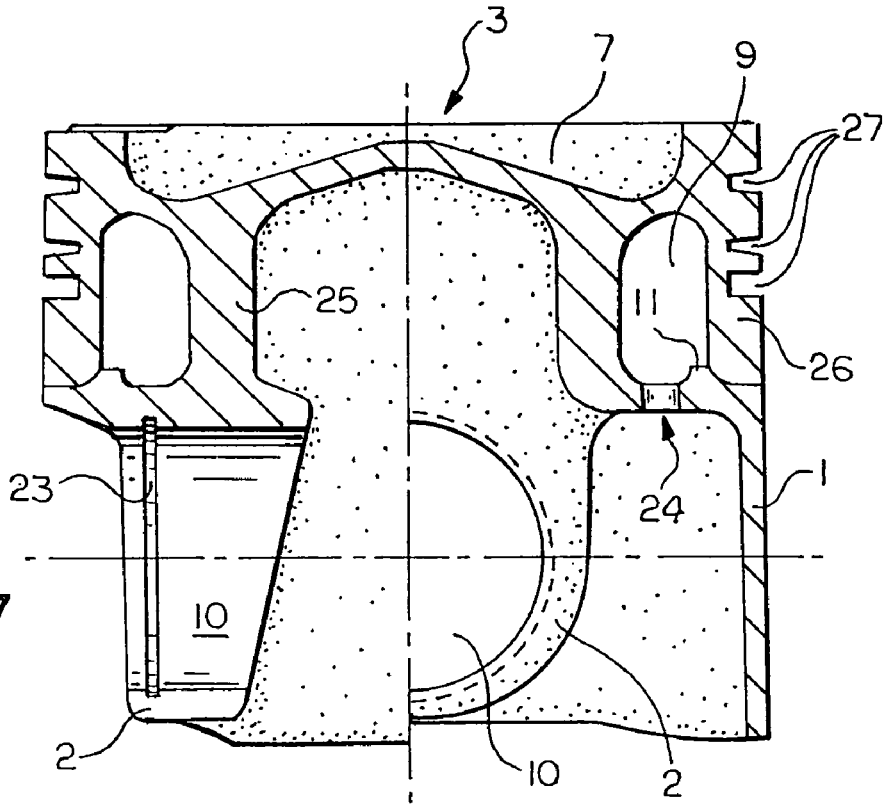
FIG. 7 is a compound cross-sectional view of a piston according to one embodiment of the present invention shown in half section with ring grooves formed into the T-form flange.

FIG. 7 is a compound cross-sectional view of a piston according to one embodiment of the present invention shown in half section with ring grooves formed into the T-form flange. FIG. 7 depicts a finished piston that include a bowl shaped crown 7 a pair of opposed pin bosses 2 with finished pin bores 10 therein (one shown) having snap ring grooves 23 formed therein (one shown). FIG. 7 also depicts an oil injection port 24 provided in the bottom of cooling gallery 9 into which oil can be injected for cooling the cooling gallery 9 according to known methods. In the piston shown in FIG. 7 the under crown area 25 has been machined away to reduce overall weight of the piston.

In one of the final manufacturing steps, the ring belt 26 (defined by the flange 4) of the piston will be provided with grooves 27 for receiving piston rings including one or more compression rings and an oil ring in a known manner.

As can be appreciated, the final piston (shown in FIG. 7) is a one-piece steel piston having an internal cooling gallery and a crown and skirt that are formed as an integrated unit. The one-piece steel piston of the present invention is made without the use of friction welding and therefore avoids problems and concerns associated with friction welding.

The process of manufacturing the one-piece steel pistons of the present invention involves forging or casting a pre-machined and pre-metal worked piston or piston blank as shown in FIG. 1 that includes a top, a skirt 1, a pair of opposed pin bosses 2 and a flange 4 that extends radially outward from the top. Optionally, the pre-machined and pre-metal worked forged or cast piston or piston blank can be forged or cast with a rough (pre-machined) crown bowl 7 and/or a rough (pre-machined) cooling gallery 9.

In the next step the cooling gallery 9 is provided or finished by a machining step and an annular abutment 1 is formed at the top 5 of the skirt 1 as shown in FIG. 2.

Next, the flange 4 is bent or folded downward so that the peripheral edge 12 of the flange 4 contacts abutment 11 and rests on the top 5 of the skirt 1 as shown in FIG. 3. Prior to bending or folding the flange 4 the flange 4 is machined so that the peripheral edge 12 cooperates with the abutment 11 and is either welded to the top 5 of the skirt 1 or mechanically engages the top 5 portion of the skirt 1. In addition, the flange 5 is machined so as to have an outer annular surface after bending or folding that is substantially flush with the annular outer surface of the skirt 1 which has also been machined to a finished state. The machining of the annular surfaces of the skirt 1 and flange 4 can be conducted after the flange 4 is bent or folded.

After the flange 4 is bent or folded grooves 27 for compression rings and an oil ring are formed in a portion of the flange 4 that defines the ring belt 26.

At any convenient time during the above steps, the pin bore and be provided and/or finished and the under crown area can be machined out as desired to reduce overall weight.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A one-piece piston that comprises:

a top;

a pair of opposed pin bosses with pin bores formed therein;

a skirt having a top portion; and a cooling gallery that is comprises an annular cavity formed in a side of the piston which annular cavity is closed by a flange that is continuous with the top of the piston and which flange has been displaced so that a peripheral terminal edge of the flange abuts the top portion of the skirt as to close the annular cavity and define a portion of the cooling gallery, said top, skirt and flange are all formed from a single blank.

2. A one-piece piston according to claim 1, wherein an abutment is provided in the cavity and the flange contacts the abutment.

3. A one-piece piston according to claim 1, wherein flange is welded to an upper portion of the skin.

4. A one-piece piston according to claim 1, wherein the flange is mechanically engaged with an upper portion of the skirt.

5. A one-piece piston according to claim 1, wherein the piston is made from a steel material.

6. A one-piece piston according to claim 1, further comprising a ring belt formed on the flange.

7. A one-piece piston according to claim 1, comprising a plurality of piston ring grooves formed in the flange.

8. A piston blank from which a piston can be fabricated, said piston blank comprising a top portion, a skirt, a pair of opposed pin bosses and a flange extending radially outward from the top portion, said flange being configured to be displaced downward to contact a top portion of the skirt.

9. A piston blank from which a piston can be fabricated according to claim 8, wherein the piston blank is formed by one of a forging or a casting process.

10. A piston blank from which a piston can be fabricated according to claim 8, further comprising an annular cavity formed under the flange.

11. A piston blank from which a piston can be fabricated according to claim 8, further comprising pin bores formed in the pin bosses.

12. A piston blank from which a piston can be fabricated according to claim 8, further comprising a crown bowl formed in the top portion.

13. A method of fabricating a one-piece piston which comprises:

providing a piston blank having a top portion, a skirt, a pair of opposed pin bosses and a flange extending radially outward from the top portion;

forming an annular cooling gallery under the flange;

displacing the flange so that an outer peripheral edge of the flange contacts a top portion of the skirt and closes off the cooling gallery; and forming piston ring grooves in the flange.

14. A method of fabricating a one-piece piston according to claim 13, wherein the annular cooling gallery is formed by a machining process.

15. A method of fabricating a one-piece piston according to claim 14, wherein the annular cooling gallery is partially formed in the piston blank and the step of forming the annular cooling gallery comprises machine finishing the annular cooling gallery.

16. A method of fabricating a one-piece piston according to claim 13, wherein the piston blank is made by one of a forging or casting process.

17. A method of fabricating a one-piece piston according to claim 13, wherein the flange is displaced by bending the flange toward the skirt.

18. A method of fabricating a one-piece piston according to claim 13, further comprising attaching the peripheral edge of the flange with the top portion of the skirt.

19. A method of fabricating a one-piece piston according to claim 18, wherein the step of attaching comprises welding the peripheral edge of the flange with the top portion of the skirt.

20. A method of fabricating a one-piece piston according to claim 18, wherein the step of attaching comprises providing the peripheral edge of the flange and the top portion of the skirt with cooperating engaging structures and engaging the peripheral edge of the flange and the top portion of the skirt with the cooperating engaging structures.

21. A method of fabricating a one-piece piston according to claim 13, wherein the flange has a diameter that is which greater that the diameter of the skirt.

22. A method of fabricating a one-piece piston according to claim 21, wherein the diameter of the flange is greater that the diameter of the skirt by an amount that is at least equal to a difference in height between the top portion of the piston blank and the top portion of the skirt.

23. A method of fabricating a one-piece piston according to claim 21, wherein the diameter of the flange is greater that the diameter of the skirt by an amount that is less than the difference in height between the top portion of the piston blank and the top portion of the skirt.

* * * * *

UNITED STATES PATENT AND TRADEMARK OFFICE

CERTIFICATE OF CORRECTION

PATENT NO. : 7,104,183 B2
APPLICATION NO. : 10/885810
DATED : September 12, 2006
INVENTOR(S) : Yuejun Huang It is certified that error appears in the above-identified patent and that said Letters Patent is hereby corrected as shown below:

On Title Page, Item -57-

Abstract, line 2, insert --is-- after "portion that"

Col. 2, line 35, delete "since"

Col. 3, line 26, insert --,-- between "folded" and "grooves"

Col. 7, line 10, delete "is"

Signed and Sealed this

Tenth Day of April, 2007

JON W. DUDAS
*Director of the United States Patent and Trademark Office*